US010207422B2

(12) United States Patent
Merusi

(10) Patent No.: US 10,207,422 B2
(45) Date of Patent: Feb. 19, 2019

(54) MOLD FOR CONCRETE BENCH SUPPORTS

(71) Applicant: Concretebenchmolds, LLC, Framingham, MA (US)

(72) Inventor: Robert Merusi, Framingham, MA (US)

( * ) Notice: Subject to any disclaimer, the term of this patent is extended or adjusted under 35 U.S.C. 154(b) by 76 days.

(21) Appl. No.: 15/070,544

(22) Filed: Mar. 15, 2016

(65) Prior Publication Data

US 2016/0271830 A1 Sep. 22, 2016

Related U.S. Application Data

(60) Provisional application No. 62/134,125, filed on Mar. 17, 2015.

(51) Int. Cl.
*B28B 7/34* (2006.01)
*A47C 5/00* (2006.01)

(52) U.S. Cl.
CPC ..... *B28B 7/348* (2013.01); *A47C 5/00* (2013.01)

(58) Field of Classification Search
CPC ..... B28B 7/0029; B28B 7/348
See application file for complete search history.

(56) References Cited

U.S. PATENT DOCUMENTS 2,618,039 A * 11/1952 Hyre ..... E04G 17/02 248/191
4,000,622 A * 1/1977 Chiaves ..... E02D 29/0266 405/286
6,090,324 A * 7/2000 Keady ..... A47C 11/00 249/139
2015/0001761 A1* 1/2015 Bratton ..... B28B 7/06 264/299

* cited by examiner

*Primary Examiner* — James Sanders
(74) *Attorney, Agent, or Firm* — Brian M. Dingman; Dingman IP Law, PC

(57) ABSTRACT

A mold for a concrete bench support structure including a closed base, a continuous wall projecting up from the circumference of the base, and structure attached to the wall that stiffens the wall.

17 Claims, 4 Drawing Sheets

MOLD FOR CONCRETE BENCH SUPPORTS

CROSS-REFERENCE TO RELATED APPLICATION

This application claims priority of Provisional Patent Application 62/134,125 filed on Mar. 17, 2015, the disclosure of which is incorporated herein by reference.

BACKGROUND

This invention relates to a set of molds or trays that are used for casting concrete bench support structures. The concrete support structures will ultimately be utilized as legs (i.e., the support structures) for benches of the type where the seat and the backrest of the benches are made of wood, plastic, or other stable material of the user's selection.

DESCRIPTION OF THE PRIOR ART

Molds for making bench support structures have previously been made using wood, metal, and plastic as forming materials. Previous plastic molds have been made where the shape and uniformity became distorted and compromised due to the mold manufacturing process (cooling) and during the concrete bench forming process. It was a common occurrence for the sides of the molding tray to bow in or out after the heated materials cooled during the manufacturing process, rendering it unusable and requiring physical manipulation of the molded material to reshape the mold into usable form. Also, in the prior art and due to limitations of some of the shapes of the molds and types of materials, the molds would lose shape during the concrete forming process, again requiring physical alterations and additional supporting methods to maintain the shape of the mold during the concrete forming process. Reshaping the mold after the manufacturing process and during the concrete forming process to a desirable fixed position often required heating and cooling mechanisms using a blow torch, spacer blocks, and clamps to preserve the right angles and other desirable shapes of the molds.

SUMMARY

The present invention is directed to address the material and rigidity of the molds used to form concrete bench support structures. The invention comprises a set of linear low density polyethylene molds (or molds made of other materials of similar function) for making a left bench support structure and a right bench support structure. Each mold has a flat base, continuous sides, and an open face for filling the mold with concrete. The sides may have pre-drilled holes for attaching anchor inserts or other fixtures that can be used for building a bench. There can be structures to stabilize the sides such that they remain vertical during use. Such stabilizing means can include an outward facing "lip" around the top or bottom circumference of the mold. The lip creates rigidity to the sides of the mold. The lip is an improvement to previous molds, as it inhibits the bowing previously described. When the lip is at the top of the sidewalls it also provides a lifting platform that can be used when separating the mold from the cast concrete support structure. When the lip is at the bottom there can also be a series of spaced vertical ribs sitting on the lip and projecting up along some, most or all of the height of the sidewalls. These ribs can stiffen the sidewalls. The ribs can be but need not be tapered, such that they are wider at the bottom than the top.

This disclosure features a mold for a concrete bench support structure including a closed base, a continuous wall projecting up from the circumference of the base, and structure attached to the wall that stiffens the wall. The structure attached to the wall that stiffens the wall may comprise a lip around the top of the wall, wherein the lip stiffens the wall and provides a surface that can be used to lift the mold. The lip may be generally flat. The lip may project outwardly at 90 degrees from the top of the wall. The lip may project outwardly about 0.5 inches. The lip may be along the entire circumference of the wall. The mold can be made from linear low density polyethylene.

The structure attached to the wall that stiffens the wall may alternatively or potentially additionally include a number of spaced ribs on the outside of the wall. The ribs may be tapered from bottom to top such that they are wider at the bottom as compared to the top. The mold may also include a lower lip projecting outwardly from the wall and that supports the bottom of the ribs.

It is an object of the present invention to provide a mechanism for building benches that is less expensive than buying a pre-made bench of a similar style.

It is an object of the present invention to provide a mechanism for making bench support structures which is less expensive, lighter, and easier to maneuver than previous bench support structure forming trays.

It is an object of the present invention to provide a durable and reusable form of molded material of construction grade that will provide longevity and years of service.

It is an object of the present invention to provide a bench making system which can be used without the services of a skilled mason.

It is an object of the present invention to provide rigidity and uniformity of a mold that maintains its intended shape without further physical manipulation.

It is an object of the present invention to provide a lifting platform for ease of handling the mold during forming and ease of separating the mold from the finished formed concrete bench end.

These and other objects and advantages of the present invention will be fully apparent from the following description, when taken in connection with the annexed drawings.

DESCRIPTION OF THE PREFERRED EMBODIMENT

Figure 1:
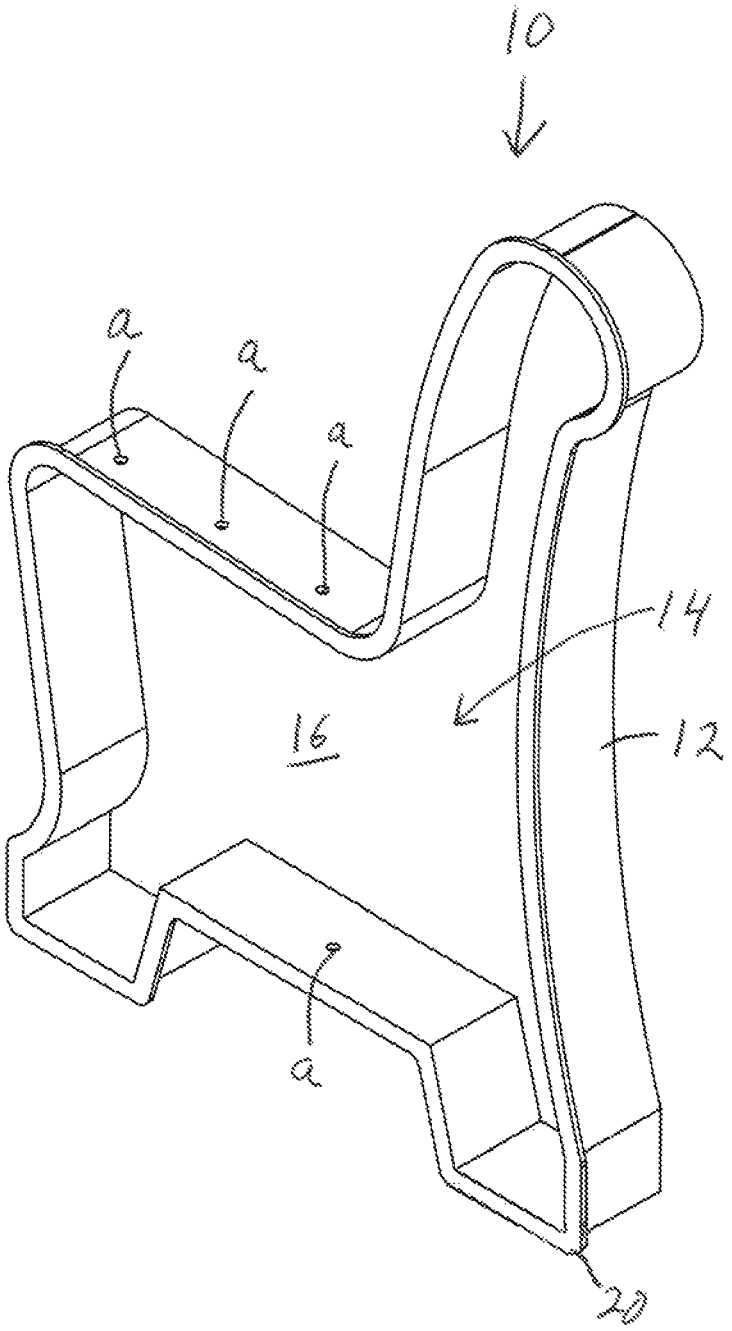
FIG. 1 is a perspective view of the front of a concrete mold of the present invention.

FIG. 1 is a perspective view of the front of one example of the molding tray or mold 10 of the present disclosure. In this view the sides 12 and open face 14 of the mold are shown. The open face 14 allows for filling of concrete into the molding tray 10, the weight of which is supported by the closed base 16. The sides 12 provide support and contain the concrete so the illustrated shape will be formed, however other supporting structures of other shapes can be used. Pre-drilled holes as shown (marked as "a", and 0.375" in diameter) may be included for attachment of anchor inserts that can be used as attachment points for the slats that are attached to two of the support structures (left and right) to form the seat and back of the bench. Holes may be included anywhere an anchor insert might be required. In this illustration, a 0.5 inch lip 20 is included at the top edge around the entire circumference of the side 12. Lip 20 preferably projects outwardly at 90 degrees from the wall and is flat. Lip 20 lends rigidity to the mold (as described in the summary) and also provides a lifting platform for ease of handling the mold during forming and ease of separating the mold from the finished formed concrete bench support structure. As one example, separation may be accomplished by lifting the mold by the lip and inverting it to release the formed support structure from the mold. Other means of stabilizing the sides of the mold may be used, but the lip (as illustrated) is an effective means.

Figure 2:
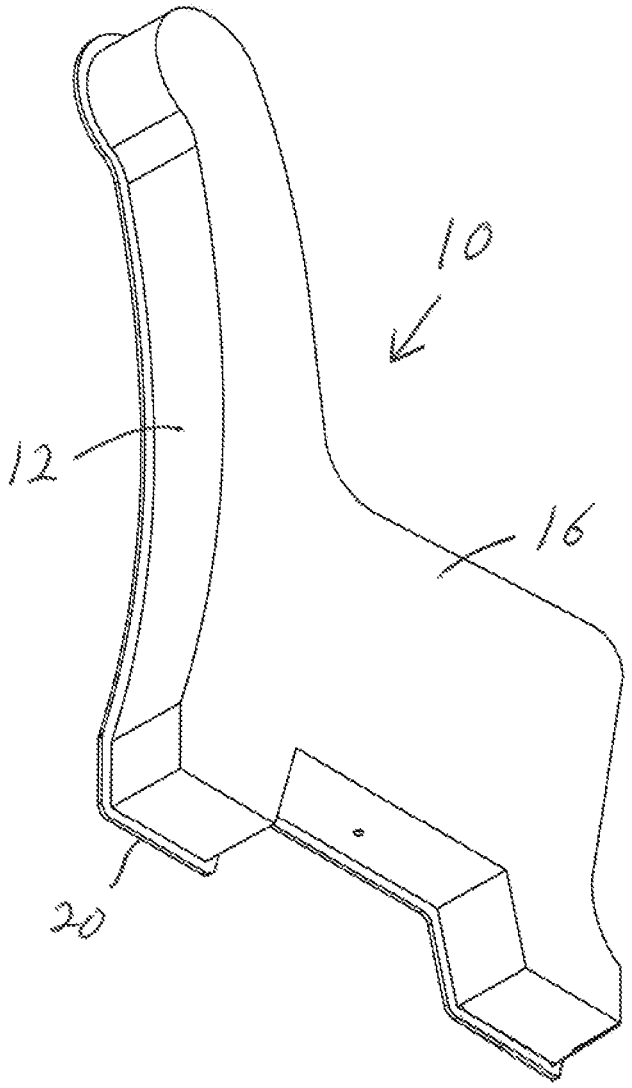
FIG. 2 is a perspective view of the base of the concrete mold of FIG. 1.

FIG. 2 is a perspective view of the base 16 of the mold 10, as well as the sides 12 with lip 20.

Figure 3:
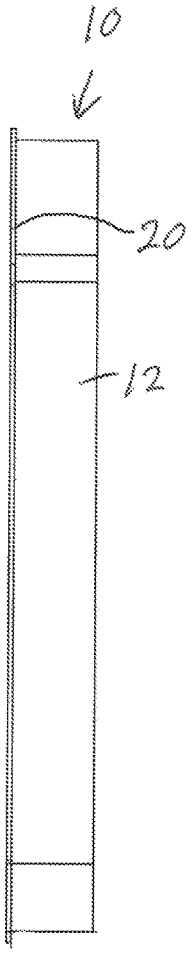
FIG. 3 is a view of the side of the concrete mold of FIG. 1.

FIG. 3 is a side view of the mold 10 with suggested measurements. In the present illustration, the preferred mold is 35.25 inches tall, and the depth of the mold is 3.62 inches. The lip adds 1 inch to the height. The measurements given are merely suggestive, and other size molds may be created.

Figure 4:
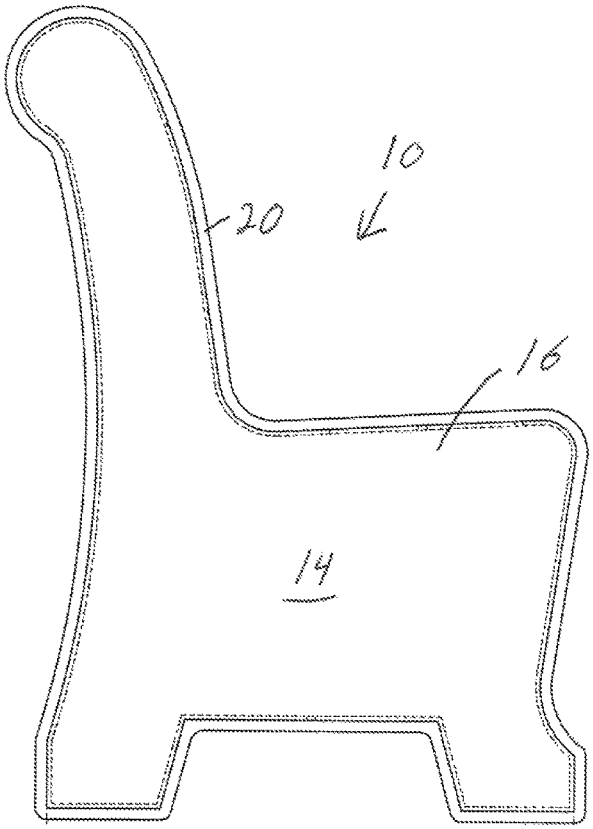
FIG. 4 is a plan view of the front of the concrete mold of FIG. 1.

FIG. 4 is a front or top plan view of the mold 10 with a width of 23.25 inches. The lip also adds one inch to the width.

Figure 5:
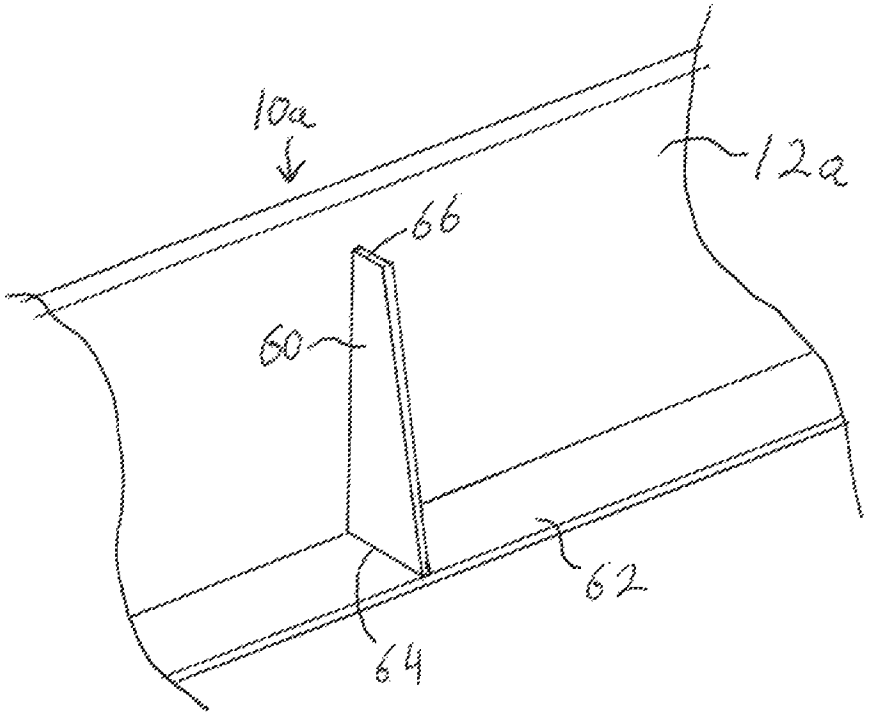
FIG. 5 is a partial front view of an alternative mold design that has a lower lip and wall-strengthening ribs.

FIG. 5 shows part of the sidewall 12*a* of an alternative embodiment of mold 10*a*. The mold has a series of ribs (only one rib 60 shown, for ease of illustration only), where the ribs are spaced around the entire circumference of the sidewall. The ribs serve to stiffen the sidewall and would typically replace the top lip that is present in example 10 shown in FIGS. 1-4. Rib 60 is attached to sidewall 12*a* along some, most or all of the sidewall height. Base 64 of rib 60 preferably sits on/is supported by a lower projecting lip 62. Rib 60 is depicted as tapered from bottom 64 to top 66, where top 66 is narrower than base 64. However, the ribs need not be tapered.

There would preferably be two molds, one for the left support structure and one for the right support structure. They would be mirror images of one another. Alternatively, a single mold can be used to form the two (or more) support structures for the bench.

What is claimed is:

1. A mold for a concrete bench support structure, comprising:

a plastic closed base with a perimeter;

a plastic continuous wall that is 0.25 inch thick or less, with an inside, an outside, a top, and a bottom having an upper and an opposing lower side, wherein the bottom is attached to the entire perimeter of the closed base and the continuous wall completely surrounds an interior volume, the interior volume in contact with the closed base and the inside of the continuous wall;

a plurality of through holes from the inside to the outside of the continuous wall for the placement of a plurality of anchors; and a plastic continuous lip that is 0.25 inch thick or less, attached around the top of the entire wall and projecting outside of the wall, at least 0.5 inch, to stiffen the continuous wall;

wherein the mold is one-piece;

wherein the plastic is a low density polyethylene;

wherein the interior volume comprises a central volume and three peninsula volumes that protrude from the central volume, the peninsula volumes comprising a front leg volume, a back leg volume, and a backrest volume;

wherein the mold, when resting on the bottom lower side, is configured to be filled with pre-set cement such that the interior volume is filled to create a continuous cement structure through the unification of the pre-set cement in the central volume, the front leg volume, the rear leg volume, and the backrest volume; and wherein the continuous wall is perpendicular to the bottom such that cement that is formed within, set, and ultimately removed from the mold is configured to have surfaces aligning with paired surfaces from an opposing mold so that a plurality of slats can be effectively attached to the paired surfaces, through fastening to the anchors, to assemble a seat and a backrest of a bench.

2. The mold of claim 1 wherein the lip is generally flat.

3. The mold of claim 2 wherein the lip projects outwardly at 90 degrees from the top of the wall.

4. The mold of claim 3 wherein the lip projects outwardly 0.5 inch.

5. The mold of claim 4 wherein the through holes are where the continuous wall is in contact with the central volume and the backrest volume.

6. A mold for a concrete bench support structure, comprising:

a low density plastic material;

a closed base with a perimeter;

a continuous wall with an inside, an outside, a top, and a bottom with an upper and an opposing lower side, wherein the bottom is attached to the entire perimeter of the closed base and the continuous wall completely surrounds an interior volume, the interior volume in contact with the closed base and the inside of the continuous wall;

a plurality of through holes from the inside to the outside of the continuous wall for the placement of a plurality of anchors; and a continuous lip attached around the top of the entire wall and projecting outside of the wall to stiffen the continuous wall;

wherein the mold is one-piece;

wherein the interior volume comprises a central volume and three peninsula volumes that protrude from the central volume, the peninsula volumes comprising a front leg volume, a back leg volume, and a backrest volume;

wherein the mold, when resting on the bottom lower side, is configured to be filled with pre-set cement such that the interior volume is filled to create a continuous cement structure through the unification of cement in the central volume, the front leg volume, the rear leg volume, and the backrest volume;

wherein the continuous wall is perpendicular to the bottom such that cement that is formed within, set, and ultimately removed from the mold is configured to have surfaces aligning with paired surfaces from an opposing mold so that a plurality of slats can be effectively attached to the paired surfaces, through fastening to the anchors, to assemble a seat and a backrest of a bench.

7. The mold of claim 6 wherein the lip is generally flat.

8. The mold of claim 7 wherein the lip projects outwardly about 90 degrees from the top of the wall.

9. The mold of claim 8 wherein the through holes are where the continuous wall is in contact with the central volume and the backrest volume.

10. The mold of claim 9 wherein the plastic is low density polyethylene.

11. The mold of claim 10 wherein the low density polyethylene is about 0.25 inch thick.

12. The mold of claim 11 further comprising a plurality of spaced ribs on the outside of the continuous wall, the ribs each having a rib top and a rib bottom, and each rib attached to both the continuous wall and the continuous lip.

13. The mold of claim 12 wherein the ribs are tapered from the rib bottom to the rib top such that they are wider at the rib bottom as compared to the rib top.

14. The mold of claim 13 further comprising a lower lip projecting outwardly from the continuous wall, where the lower lip supports the rib bottoms.

15. The mold of claim 5 further comprising a plurality of spaced ribs on the outside of the continuous wall, the ribs each having a rib top and a rib bottom, and each rib attached to both the continuous wall and the continuous lip.

16. The mold of claim 15 wherein the ribs are tapered from the rib bottom to the rib top such that they are wider at the rib bottom as compared to the rib top.

17. The mold of claim 15 further comprising a lower lip projecting outwardly from the continuous wall, where the lower lip supports the rib bottoms.

* * * * *